US010814522B2

(12) United States Patent
Walker et al.

(10) Patent No.: US 10,814,522 B2
(45) Date of Patent: Oct. 27, 2020

(54) STUCCO PAPER SCREEN ASSEMBLY

(71) Applicant: UNITED STATES GYPSUM COMPANY, Chicago, IL (US)

(72) Inventors: Blair Walker, Timmins (CA); Erin Stewart, Stoney Creek (CA)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 330 days.

(21) Appl. No.: 15/811,372

(22) Filed: Nov. 13, 2017

(65) Prior Publication Data

US 2019/0143560 A1 May 16, 2019

(51) Int. Cl.

| | |
|---|---|
| ***B28B 3/20*** | (2006.01) |
| ***B28B 3/22*** | (2006.01) |
| ***B07B 1/55*** | (2006.01) |
| ***B07B 1/24*** | (2006.01) |

(52) U.S. Cl.

CPC ..... *B28B 3/206* (2013.01); *B07B 1/24* (2013.01); *B07B 1/55* (2013.01); *B28B 3/222* (2013.01)

(58) Field of Classification Search

CPC ..... B28B 3/206; B28B 3/222; B07B 1/55; B07B 1/24

See application file for complete search history.

(56) References Cited

U.S. PATENT DOCUMENTS

| | | | | |
|---|---|---|---|---|
| 2,862,668 | A | 12/1958 | Stohsner | |
| 4,282,090 | A | 8/1981 | Hoernschmeyer et al. | |
| 4,940,187 | A * | 7/1990 | Lee | B03B 5/40 209/172.5 |
| 5,524,769 | A | 6/1996 | Spencer | |
| 6,164,572 | A | 12/2000 | Tudahl et al. | |
| 6,471,767 | B1 | 10/2002 | Konczak | |
| 6,615,710 | B1 | 9/2003 | Ishigaki et al. | |
| 8,011,606 | B1 | 9/2011 | Chrestenson | |
| 2007/0228200 | A1 | 10/2007 | Ulitsch et al. | |

(Continued)

FOREIGN PATENT DOCUMENTS

| | | | |
|---|---|---|---|
| DE | 8807867 | U1 | 8/1988 |
| EP | 2324926 | B1 | 12/2012 |

(Continued)

OTHER PUBLICATIONS

International Search Report from International Patent Application No. PCT/US2018/060588, dated Feb. 14, 2019.

*Primary Examiner* — Nahida Sultana

(74) *Attorney, Agent, or Firm* — Greer, Burns & Crain, Ltd.; Philip T. Petti; Pradip Sahu

(57) ABSTRACT

A screen assembly includes a housing defining a material flow chamber and having an inlet end and an outlet end, and a stucco discharge opening being located in the chamber between the inlet end and the outlet end. An auger shaft is located in the housing for axial rotation and having at least one first helical flight arranged in a flight pattern oriented so that material engaging the first helical flight is conveyed from the inlet end to the outlet end. A screen surrounds the at least one first helical flight for common rotation and extends generally from the inlet end to the outlet end. At least one second helical flight is disposed on an exterior surface of the screen and is arranged in a flight pattern oriented so that material engaging the second helical flight is conveyed in a direction from the outlet end.

9 Claims, 7 Drawing Sheets

(56) References Cited

U.S. PATENT DOCUMENTS

| | | | | |
|---|---|---|---|---|
| 2008/0185463 | A1* | 8/2008 | Schlesinger | B02C 17/16 241/19 |
| 2009/0218259 | A1* | 9/2009 | Mori | B07B 1/24 209/559 |
| 2011/0198268 | A1* | 8/2011 | DeWaard | B01D 33/11 209/270 |
| 2014/0064020 | A1* | 3/2014 | Kalidindi | B01F 9/005 366/223 |
| 2014/0306037 | A1 | 10/2014 | Shideler, Jr. et al. | |
| 2015/0136662 | A1* | 5/2015 | Valerio | B09B 3/00 209/3 |
| 2016/0082478 | A1 | 3/2016 | Walton et al. | |
| 2018/0065152 | A1* | 3/2018 | Hasa | A01K 67/033 |
| 2018/0304324 | A1* | 10/2018 | Oude Grotebevelsborg | B03B 9/06 |

FOREIGN PATENT DOCUMENTS

| | | | | |
|---|---|---|---|---|
| GB | 191023515 | A | 3/1911 | |
| JP | 10-005615 | * | 1/1998 | B02C 19/22 |
| JP | H10-5615 | A | 1/1998 | |
| JP | 2001009434 | A | 1/2001 | |
| JP | 2001149911 | A | 6/2001 | |
| JP | 2003088775 | A | 3/2003 | |
| JP | 2011011210 | A | 1/2011 | |
| NL | 8201829 | A | 12/1983 | |
| WO | 0076935 | A1 | 12/2000 | |
| WO | 2016/151153 | A1 | 9/2016 | |

* cited by examiner

STUCCO PAPER SCREEN ASSEMBLY

BACKGROUND

The present invention relates to gypsum wallboard manufacturing, and more specifically, relates to an improved system for recycling gypsum wallboard panels so that waste paper is separated from reusable stucco.

Gypsum wallboard manufacturing plants customarily incorporate varying amounts of recycled materials into the production process. In many cases, scrap or defective wallboard panels are recycled to extract the reusable core, which as a primary ingredient includes calcium sulfate hemihydrate, also known as land plaster or stucco. For the purposes of this application, "stucco" will refer to the core material of wallboard panels. As is well known in the art, gypsum wallboard panels are made of a core of set gypsum composition, covered by layers of face and back paper, which provide structural support for the core. In this application "stucco paper" will refer to these facing layers. During the recycling process, the existing panels are ground up, and the ground material is forwarded from the grinder by an auger conveyor to a rotating, drum-like screen separator. The separator is constructed and arranged to retain the scraps of face and backing paper, and allow the stucco powder and particles to fall through by gravity to a hopper. Collected stucco is then reused in the wallboard manufacturing process.

A common drawback of this recycling process is that the separator screen, typically woven wire mesh, collects scraps of paper in the screen, causing an effect referred to as "blinding over," and/or paper and oversized material is not removed from the screen fast enough, resulting in the accumulation of paper. Blinding over refers to a condition where the paper scraps block the openings in the screen to the extent that the flow of stucco into the collection hopper is impeded. Instead of falling to its intended location, a percentage of the recyclable stucco flows with the waste paper towards the paper collection receptacle, which is usually disposed of. Attempts to reuse the diverted stucco have suffered from an excess of paper in the stucco. Also, due to limited space at the wallboard plant, any effective recycling apparatus needs to be relatively compact.

Thus, there is a need for an improved wallboard recycling apparatus which prevents "blinding over" and improves separation of paper and stucco.

SUMMARY

The above-listed need is addressed by the present stucco paper screen assembly, including an inner screw conveyor shaft and flights, with a cylindrical screen connected around the outer diameter of the inner screw, creating a permeable membrane around the screw. On the outer face of the screen, a second, larger diameter set of flights is connected, forming an outer screw. The outer screw flights are configured for directing material flow in a desired direction, preferably an opposite direction from that of the inner screw flights, however a co-current direction with the first flights is also contemplated, depending on the location of a stucco discharge opening. Both the inner screw, screen and outer screw flights are interconnected and rotate together. An advantage of the present assembly is that it is installed around an existing auger conveyor that is used to transport ground recycled wallboard panel materials in a wallboard manufacturing plant to the stucco discharge opening. Power for the dual flighted screen is obtained from the same motor, pulley and belt system of the existing woven wire conveyor.

As the ground wallboard material enters the inner screw, undersize material, preferably stucco powder and small particles, falls through the screen to the stucco discharge opening. If the opening is missed for some reason, such as the stucco being temporarily entrained with paper scraps, the stucco eventually falls through the screen to be engaged by the outer flights. These outer flights have a preferably helical design configured to move the collected stucco powder in the outer casing trough in a direction to a desired output, preferably the stucco discharge opening. In the preferred embodiment, the movement is reverse relative to the movement of material internal to the screen by the inner flights. The latter flights move the material to a paper scrap collection apparatus. It is preferred that the outer flights direct the collected material to the stucco discharge opening. Larger size material from the ground wallboard, primarily paper scraps, is retained within the screen, and is moved by the inner flights toward the paper collection apparatus.

In the present assembly, the screen is generally cylindrical-drum-shaped, and is fabricated from steel sheet material that is perforated, with the holes approximately ¼ inch in diameter. After perforation, the sheets of screen are shaped to fit around peripheral edges of the first or inner flights. It is preferred that the screen is removable in semi-cylindrical portions which provide operator access to the inner screw conveyor in the event of a clog.

Another feature of the present screen assembly is an air knife system, which includes several air knife outlets constructed and arranged for emitting compressed air. The knives are directed at, and in operational relation to, the screen openings and are periodically fed compressed air for dislodging larger scraps of paper or other debris from the screen openings. Compressed air periodically fed to individual air knife jets forces material from the screen towards the interior of the drum, where the material is then caught by the inner flights for movement towards the paper scrap collection apparatus. This pattern of air pulse distribution allows the use of existing factory air supply, optionally at 80-100 psi but variable as to specific plant location, and subject to reduction by a regulator as desired, for obtaining desired pressure, such as, for example 70 psi, however other values are contemplated, yet provides sufficiently strong pulses for dislodging paper scraps from the screen.

Regarding the paper collection apparatus, this assembly includes a collected oversize material discharge chute with a significant vertical component that is in communication with a paper collection container. The oversize material discharge chute is preferably provided with a rotary valve for preventing updrafts of air in the chute from preventing the fall of paper scraps to the container by gravity. Since the collection container is typically located outside, a hood is provided for protecting the collected paper from exposure to the elements.

More specifically, the present screen assembly includes a housing defining a material flow chamber and having an inlet end and an outlet end, and a stucco discharge opening being located in the chamber between the inlet end and the outlet end. An auger shaft is located in the housing for axial rotation and having at least one first helical flight arranged in a flight pattern oriented so that material engaging the first helical flight is conveyed from the inlet end to the outlet end. A screen surrounds the at least one first helical flight for common rotation and extends generally from the inlet end to the outlet end. At least one second helical flight is disposed on an exterior surface of the screen and is arranged in a flight pattern oriented so that material engaging the second helical flight is conveyed in a direction to the stucco discharge opening.

In another embodiment, a screen assembly is provided, including a housing defining a material flow chamber and having an inlet end and an outlet end. A stucco discharge opening is located in the chamber between the inlet end and the outlet end, and an auger shaft is located in the housing for axial rotation. The shaft has at least one first helical flight arranged in a flight pattern oriented so that material engaging the first helical flight is conveyed from the inlet end to the outlet end.

A screen surrounds the at least one first helical flight for common rotation and extends generally from the inlet end to the outlet end. The screen is fabricated from perforated sheet material, and is provided in a plurality of semi-cylindrical segments individually attachable to the at least one first flight. At least one second helical flight is disposed on an exterior surface of the screen and is arranged in a flight pattern oriented so that material engaging the second helical flight is conveyed in a direction toward the stucco discharge opening. Also, at least one air knife is constructed and arranged for directing compressed air to the screen for dislodging material caught on an interior surface of the screen.

DETAILED DESCRIPTION

Figure 1:
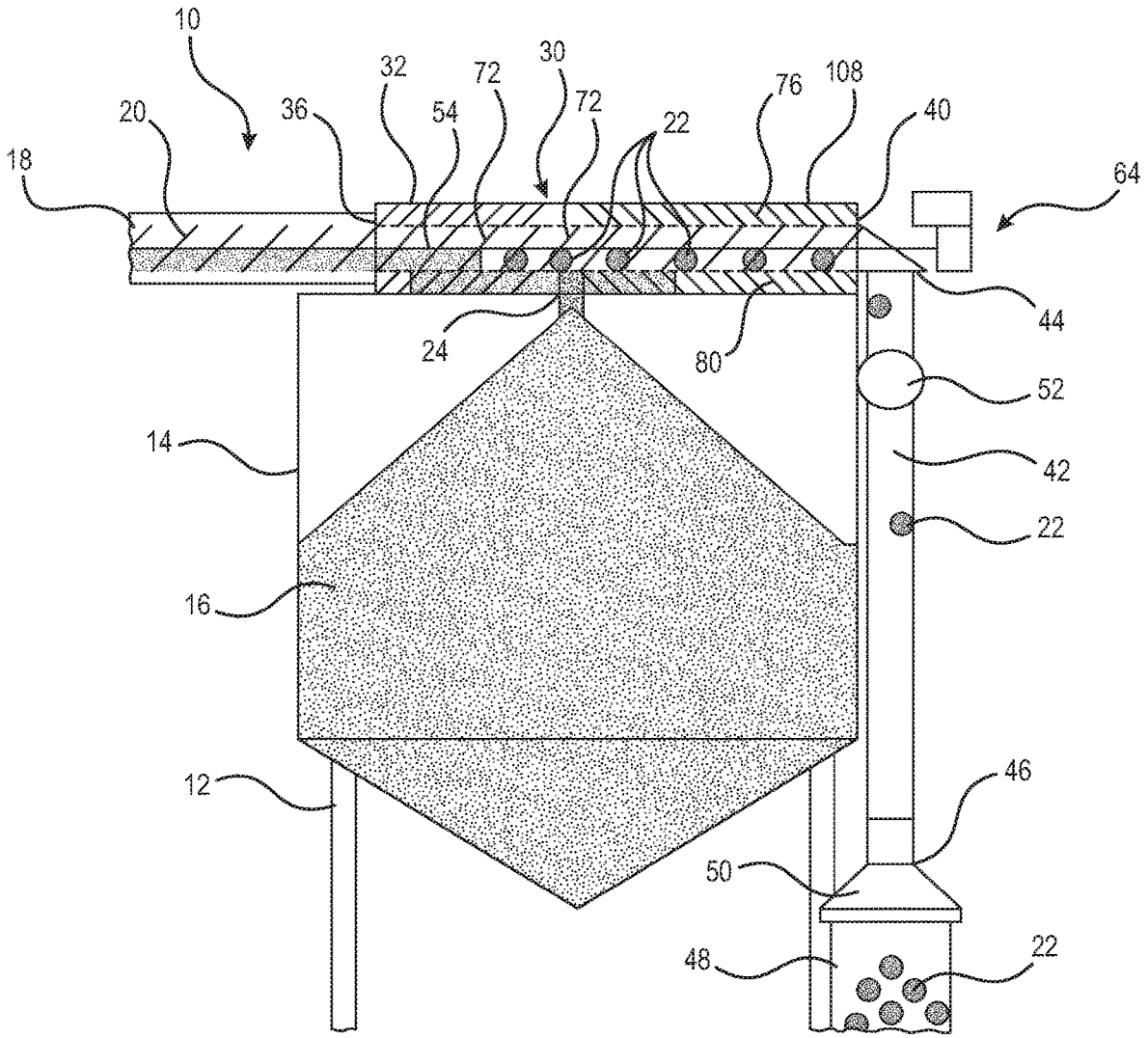
FIG. 1 is a schematic view of the present stucco paper screen assembly.

Referring now to FIG. 1, the present screen assembly is generally designated 10, and includes a support frame 12, preferably made of steel or other structurally strong and durable material as known in the art. A hopper 14 is supported by the frame 12 and is constructed and arranged for receiving and retaining via gravity flow a supply of powdered stucco 16, obtained from recycling discarded wallboard panels, fragments of such panels, or other wallboard scraps created in the wallboard panel manufacturing process.

A main conveyor 18 featuring an axially rotating helical auger 20 conveys the comminuted or chopped up wallboard fragments from a source area (not shown) for separation of the desired ground stucco 16 from unwanted paper scraps 22. As is known in the art, the paper scraps 22 were originally used to form face or backing surfaces of the wallboard panels. Since the used paper 22 has less recyclable value than the stucco, and impedes the quality of the stucco, it needs to be separated for efficient reuse of the stucco. Stucco powder 16 falls from the conveyor 18 into the hopper 14 through a stucco discharge opening 24.

Figure 2:
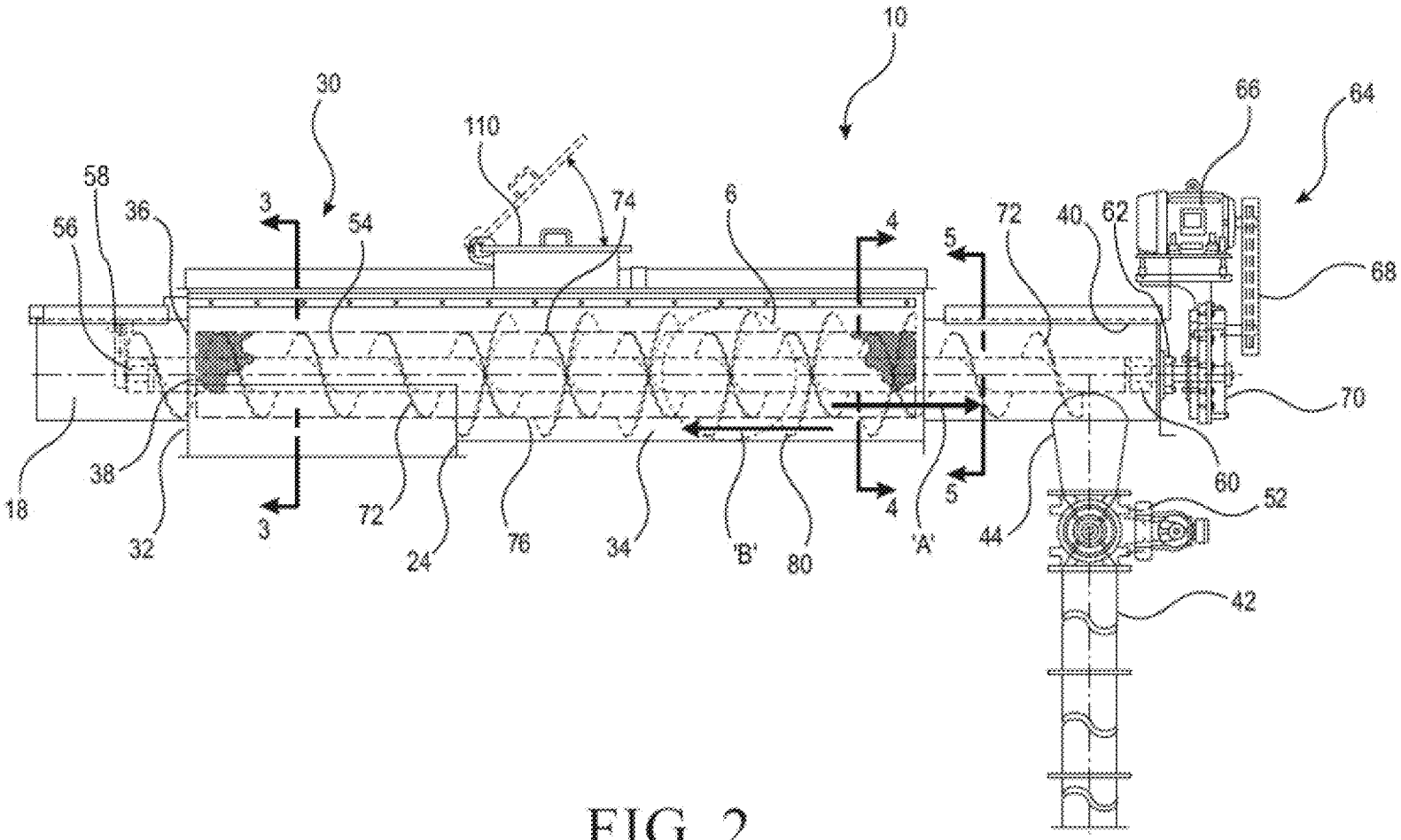
FIG. 2 is a fragmentary vertical cross-section of the present screen assembly.
Figure 5:
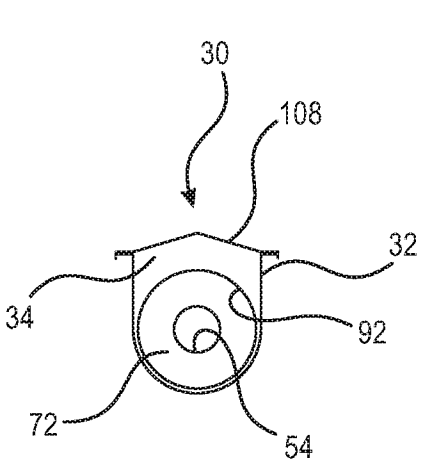
FIG. 5 is a vertical section taken along the line 5-5 of FIG. 2 and in the direction generally indicated.
Figure 4:
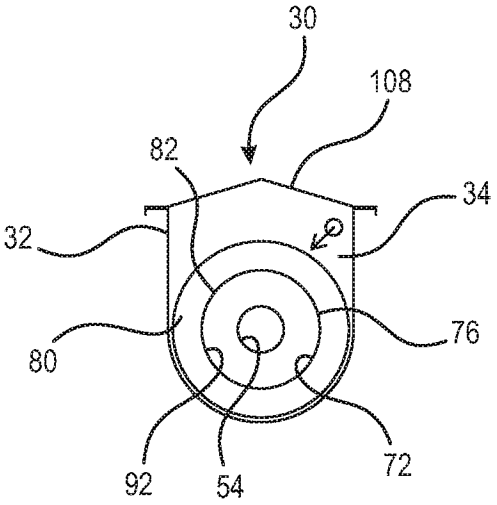
FIG. 4 is a cross-section taken along the line 4-4 of FIG. 2 and in the direction generally indicated.
Figure 3:
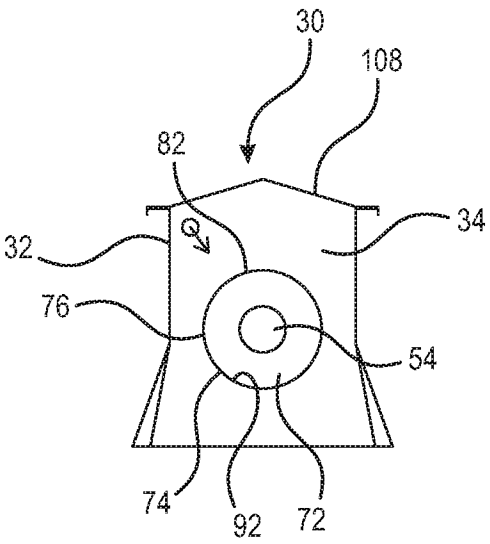
FIG. 3 is a cross-section taken along the line 3-3 of FIG. 2 and in the direction generally indicated.
Figure 6:
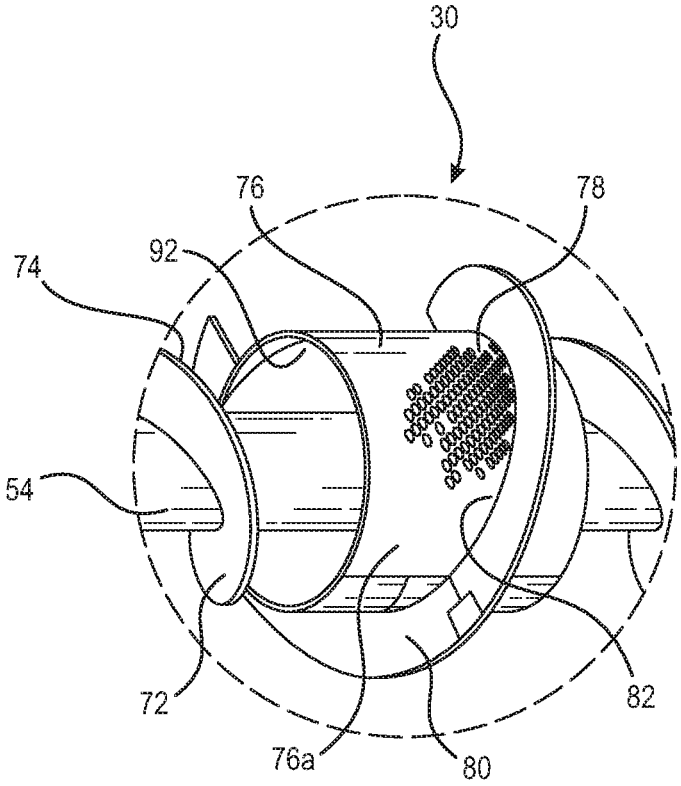
FIG. 6 is an enlarged fragmentary view of the present perforated screen with inner and outer flights.

Referring now to FIGS. 1 and 2, the present paper removing apparatus, generally designated 30, is part of the screen assembly 10 and provides an improved system for more effectively separating the undesirable paper scraps 22 from the desired ground stucco 16. Included in the apparatus 30 is an elongate housing 32 defining a material flow chamber 34. The housing 32 has an inlet end 36 which is in fluid communication with the main conveyor 18, and preferably receives an end 38 or portion of the auger 20, which projects into the material flow chamber 34. Opposite the inlet end 36 of the housing 32 is an outlet end 40 which is in fluid communication with, and connected to a collected oversize material discharge chute 42 at a tube end 44. It is preferred that the stucco discharge opening 24 is located in the housing 32 between the inlet end 36 and the outlet end 40, and especially preferably closer to the inlet end.

The material discharge chute 42 is preferably oriented generally vertically. An opposite end 46 of the chute 42 is connected to a collection bin 48 for collecting material, namely the paper scraps 22, separated out from the discarded wallboard by the present paper separating apparatus 30. In the preferred embodiment, the collection bin 48 is provided with a protective cover 50, since the bin is typically located outside and exposed to the elements. In the preferred embodiment, to promote the vertically downward flow of paper scraps 22 through the collected oversize material discharge chute 42 to the collection bin 48, against ambient air currents, a rotary valve 52 is connected to, and in fluid communication with, the tube as is known in the art.

Referring now to FIGS. 1 and 2, and returning to the inlet end 36 of the housing 32, the auger 20 rotates axially and conveys fragmented wallboard panels into the material flow chamber 32 located within the housing. The present paper separating apparatus 30 features an auger shaft 54, which is actually an extension of the auger 20 that is located in the housing 32 for axial rotation. At one end 56, the shaft 54 is supported in a bearing 58, and at the opposite, driven end 60, the shaft is supported by another bearing 62 and is connected to a motor drive system 64. Included in the motor drive system 64, in the preferred embodiment, a motor 66 is operatively connected to a pulley and belt drive 68 which is connected to a gear-reducing transmission 70. The auger shaft 54 is connected to the gear-reducing transmission 70 as is known in the art, so that the motor 66 causes the shaft to rotate axially.

Referring now to FIGS. 2-7, also included on the shaft 54 is at least one first helical flight 72 arranged in a flight pattern, including flight radius and density per linear foot, and is oriented so that material engaging the flight is conveyed from the inlet end 36 to the outlet end 40 of the housing 32. It will be seen that, in the preferred embodiment, the first helical flight 72 has the same flight pattern as the auger 20, however other patterns are contemplated. An outer peripheral edge 74 of the first helical flight 72 provides a mounting reference point for a screen 76 which surrounds the first helical flight for common rotation. It is preferred that the screen 76 extends generally from the inlet end 36 to the outlet end 40 of the housing 32.

A common problem of prior paper separating devices, which typically employed screens made of woven wire filaments, is that paper scraps often became caught or lodged in the wire screen, thus inadvertently blinding the screen to the flow of powdered stucco. To prevent this problem, the present screen 76 is preferably a sheet or plate of steel or similar material in which a plurality of holes 78 (FIGS. 8 and 9) are formed by drilling, stamping or the like. After the screen 76 is perforated, it is preferably formed in an arc or semi-cylindrical shape to complement the outer peripheral edge 74 of the first helical flight 72. For facilitating maintenance of the apparatus 30, it is preferred that the screen 76 is provided in a plurality of arcuate, perforated segments 76*a* (FIG. 6), each separately attachable to the first helical flight 72.

Referring now to FIGS. 2, 4 and 6-9, another feature of the apparatus 30 is at least one second helical flight 80 disposed on an exterior surface 82 of the screen 76 and arranged in a flight pattern oriented so that material engaging the second helical flight is conveyed in a direction to the stucco discharge opening 24. In the preferred embodiment, the second helical flight 80 conveys collected material from the outlet end 40 to the stucco discharge opening 24. Thus, the preferred direction of material flow directed by the second helical flight 80 is opposite or reverse to that of the first helical flight 72, however, co-current direction is also contemplated, depending on the location of the stucco discharge opening. Where the first helical flight 72 directs material to the oversize material discharge chute 42 shown by the arrows 'A', the second helical flight 80 directs material to the stucco discharge opening 24, shown by the arrows 'B' (FIG. 2). A radius of the second helical flight 80 is such that a peripheral edge 84 of the flight is enclosed within the chamber 34 of the housing 32 with sufficient clearance to accommodate rotation of the shaft 54, the first flight 72, the screen 76 and the second flight 80, all of which rotate as a unit under power generated by the motor 66. Also, referring again to FIG. 2, it will be noted that in the preferred embodiment, the second flight 80 does not extend the full length of the screen 76, but extends only from the outlet end 40 to a first edge of the stucco discharge opening 24. It is also contemplated that the first or inner flight 72 extends a longer distance than the second or outer flight 80.

The apparatus 30 is constructed and arranged so that mixed stucco 16, scrap paper 22 and chunks of discarded wallboard panels are conveyed by the conveyor 18 into the material flow chamber 34. Ideally, the screen holes 78 creating the perforations are dimensioned so that the paper scraps 22 are retained within the screen on the side of the first helical flight 72, which conveys the collected scraps to the outlet end 40 and ultimately, through the chute 42 to the collection bin 48.

At the same time, the stucco powder 16 is preferably of a relatively small particle size compared to the paper scraps 22, and has a granular or powdery consistency that readily passes through the screen holes 78 into the chamber 34, where the particles are collected by the second helical flight 80 and conveyed towards the inlet end 36, more specifically toward the stucco discharge opening 24.

Figure 7:
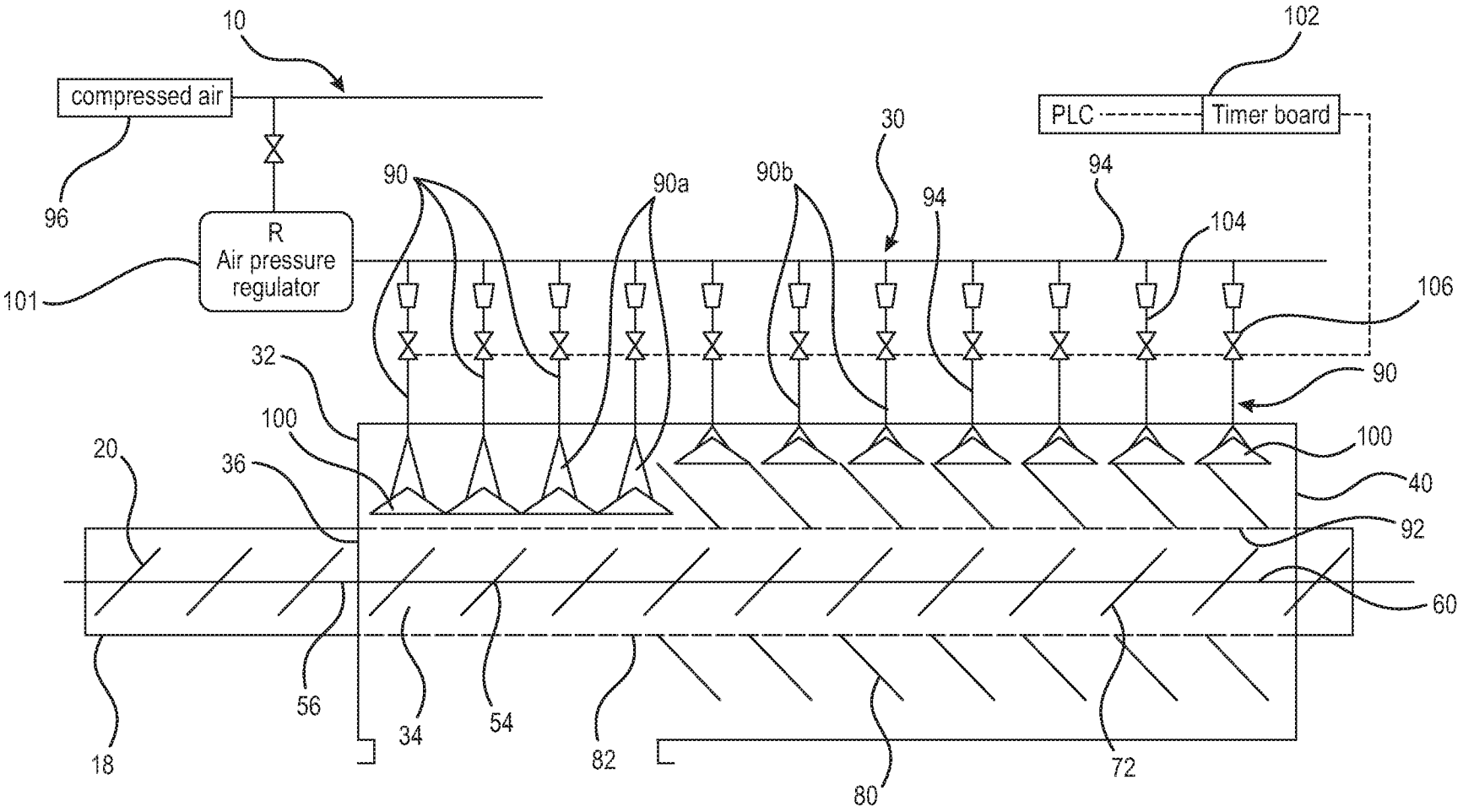
FIG. 7 is a schematic vertical cross-section of the present screen assembly.
Figure 8:
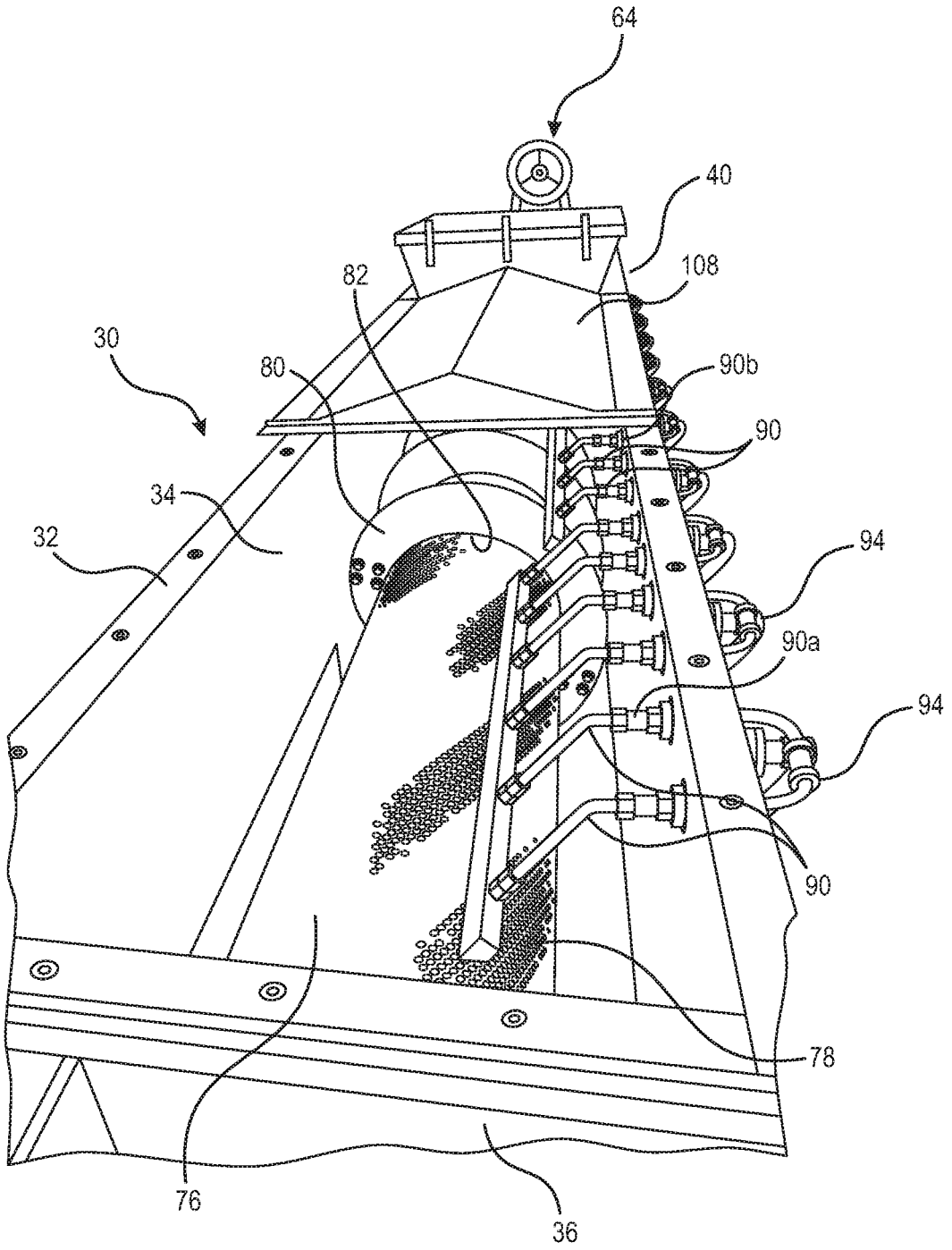
FIG. 8 is a fragmentary top perspective view of the present screen assembly with a section of the top cover removed.
Figure 9:
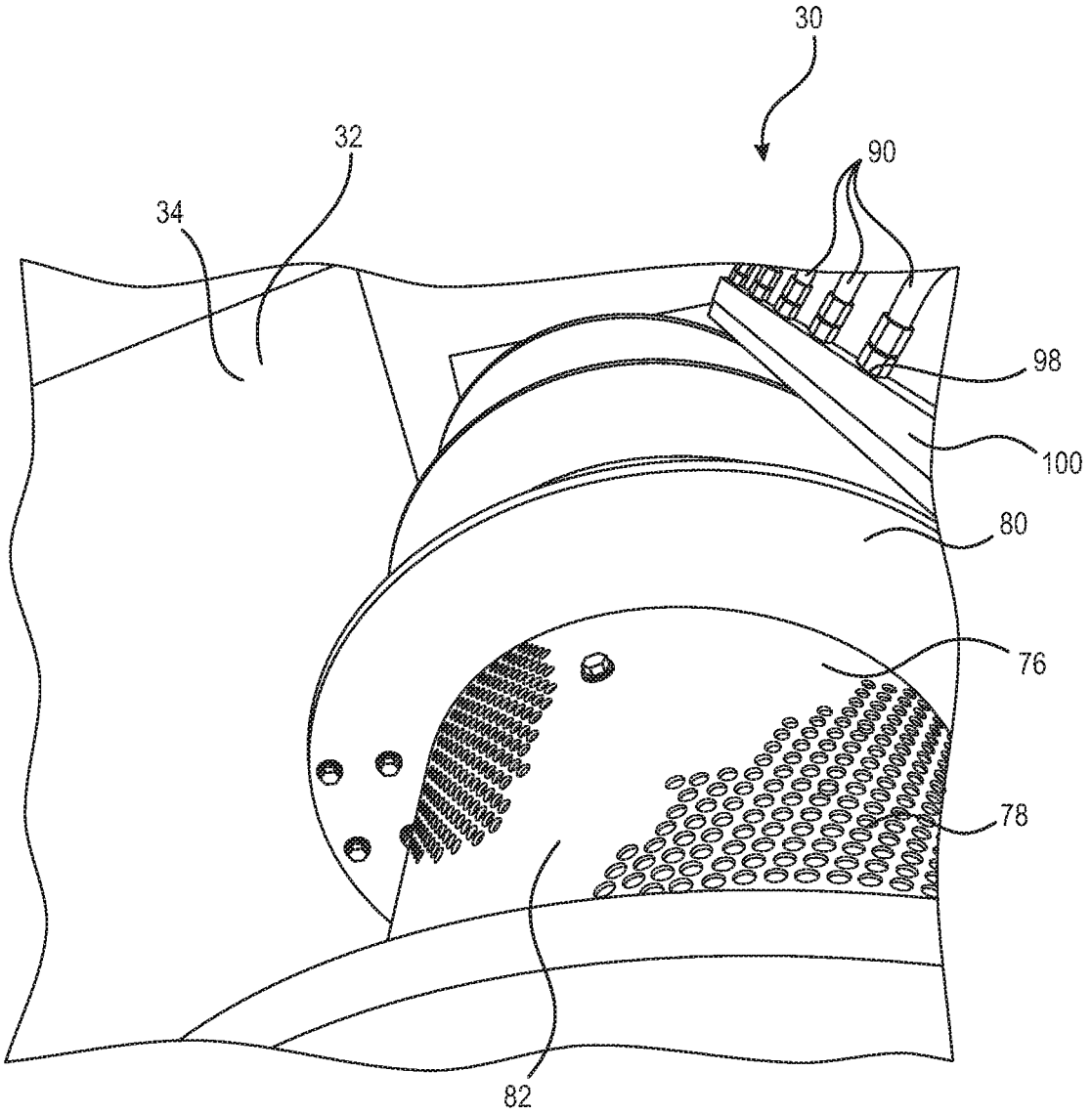
FIG. 9 is a fragmentary enlarged top perspective view of the screen assembly of FIG. 8.

Referring now to FIGS. 7-9, another feature of the present assembly 10, and more specifically the present paper separating apparatus 30, is at least one air knife, generally designated 90, which is constructed and arranged for directing jets of compressed air to the screen for dislodging material caught on an interior surface 92 of the screen. It is preferred that the jets of compressed air are directed at the exterior surface 82 of the screen 76 so that the compressed air blows any trapped paper scraps 22 towards the interior of the screen. As such, the action of the at least one air knife 90 is to dislodge the paper scraps 22 from the screen 76 and free them up for being conveyed by the first flights toward the chute 42, where they are conveyed to the collection bin 48.

In the preferred embodiment, there are a plurality of the air knives 90 disposed in spaced, linear arrangement so that an entire length of the screen 76 is exposed to compressed air jets. It is preferred that the screen 76 extends almost the full length of the housing 32, with appropriate clearance to promote free rotation of the combined screen and flights 72, 80.

As seen in FIGS. 7-9, each air knife 90 is connected by a piping system 94 to a source of compressed air 96. In the preferred embodiment, the source of air 96 is the same as used by the gypsum plant, however a dedicated compressor, or other source of compressed air is also contemplated. The air knives 90 are supplied compressed air from the existing factory air supply, optionally at 80-100 psi but variable as to specific plant location and provide jets of compressed air that are sufficiently strong pulses for dislodging paper scraps from the screen. Free ends 98 of the air knives 90 are preferably provided with nozzles 100 for directing the air more forcefully at a desired location as is known in the art. A regulator 101 is connected to the piping system 94 for adjusting the pressure of the compressed air applied to the air knives 90 as desired. In one embodiment, the regulated air pressure is 70 psi, but this is contemplated as varying to suit the application. As seen in FIG. 8, the nozzle 100 takes the form of a linearly arranged chute that generates a line of forced air along an axis that is parallel to the axis of rotation of the screen 76. Alternately, as seen in FIG. 7, the nozzles 100 are also contemplated as being fan-type, as is known in the art.

Referring to FIGS. 7 and 8, another feature of the present air knife 90 is that there is a first plurality of such knives 90*a* at a first height in operational relationship to the exterior surface 82 of the screen, and a second plurality of knives 90*b* at a second height in operational relationship to the outer or peripheral edge 84 of the at least one second flight 80. As such, the second plurality of knives 90*b* rotationally accommodates the movement of the combined screen 76 and flights 72, 80.

To conserve the compressed air, a control unit 102, preferably including a processor and associated circuitry that is connected to a distribution manifold 104. The manifold 104 is part of the piping system 94 and includes at least one valve 106, and under the control of the control unit 102, is provided to generate periodic pulses of compressed air from the knives 90*a*, 90*b*. The result is a periodic flushing or dislodgement of trapped scrap paper 22 from the screen 76 with a more efficient use of compressed air.

Referring again to FIG. 2, the housing 32 is preferably provided with a cover 108 to protect the recycled stucco, as well as the components of the assembly 30 from the elements. In addition, a user access port 110 is also provided in the cover 108.

While a particular embodiment of the present stucco paper screen assembly has been described herein, it will be appreciated by those skilled in the art that changes and modifications may be made thereto without departing from the invention in its broader aspects and as set forth in the following claims.

The invention claimed is:

1. A screen assembly, comprising:

a housing defining a material flow chamber and having an inlet end and an outlet end;

a stucco discharge opening being located in said chamber between said inlet end and said outlet end;

an auger shaft located in said housing for axial rotation and having at least one first helical flight arranged in a flight pattern oriented so that a first material engaging said first helical flight is conveyed from said inlet end to said outlet end;

a screen surrounding said at least one first helical flight for common rotation and extending generally from said inlet end to said outlet ends;

at least one second helical flight disposed on an exterior surface of said screen and arranged in a flight pattern oriented so that a second material, distinct from the first material, passing through said screen and engaging said second helical flight is conveyed towards said stucco discharge opening;

a power unit and a power transmission system connected to said power unit for rotating in common said shaft, said at least one first flight, said screen and said at least one second flight;

at least one air knife constructed and arranged for directing jets of compressed air to said screen for dislodging material caught on an interior surface of said screen, a plurality of said at least one air knife disposed so that an entire length of said screen is exposed to said air jets; and wherein said plurality of air knives includes a first plurality of knives at a first height in operational relationship to said exterior surface of said screen, and a second plurality of knives at a second height in operational relationship to an outer edge of said at least one second flight.

2. The screen assembly of claim 1, wherein said stucco discharge opening is located closer to said inlet than to said outlet.

3. The screen assembly of claim 1, wherein said screen is fabricated from perforated sheet material.

4. The screen assembly of claim 1, further including a control unit and at least one valve connected to said at least one knife for emitting periodic pulses of compressed air through said at least one knife.

5. The screen assembly of claim 1, further including an oversize material discharge chute connected to said outlet end at one end and to a collection bin at an opposite end for collecting material held within said screen and conveyed by said at least one first flight to said outlet end.

6. The screen assembly of claim 5, further including a rotary valve in fluid communication with said chute.

7. A screen assembly, comprising:

a housing defining a material flow chamber and having an inlet end and an outlet end;

a stucco discharge opening being located in said chamber between said inlet end and said outlet end;

an auger shaft located in said housing for axial rotation and having at least one first helical flight arranged in a flight pattern oriented so that a first material engaging said first helical flight is conveyed from said inlet end to said outlet end;

a screen surrounding said at least one first helical flight for common rotation and extending generally from said inlet end to said outlet end, said screen is fabricated from perforated sheet material, said screen is provided in a plurality of semi-cylindrical segments individually attachable to said at least one first flight;

at least one second helical flight disposed on an exterior surface of said screen and arranged in a flight pattern oriented so that a second material, distinct from the first material, passing through said screen and engaging said second helical flight is conveyed in an opposite direction from the first material engaging said first helical flight, and from said outlet end toward said stucco discharge opening; and a plurality of air knives constructed and arranged for directing compressed air to said screen for dislodging material caught on an interior surface of said screen; and said plurality of air knives includes a first plurality of knives at a first height in operational relationship to said exterior surface of said screen, and a second plurality of knives at a second height distinct from said first height in operational relationship to an outer edge of said at least one second flight.

8. The screen assembly of claim 7, further including said plurality of air knives is disposed so that an entire length of said screen is exposed to said compressed air.

9. A screen assembly, comprising:

a housing defining a material flow chamber and having an inlet end and an outlet end;

a stucco discharge opening being located in said chamber between said inlet end and said outlet end;

an auger shaft located in said housing for axial rotation and having at least one first helical flight arranged in a flight pattern oriented so that a first material engaging said first helical flight is conveyed from said inlet end to said outlet end;

a screen surrounding said at least one first helical flight for common rotation and extending generally from said inlet end to said outlet end, said screen is fabricated from perforated sheet material, said screen is provided in a plurality of semi-cylindrical segments individually attachable to said at least one first flight;

at least one second helical flight disposed on an exterior surface of said screen and arranged in a flight pattern oriented so that a second material, distinct from the first material, passing through said screen and engaging said second helical flight is conveyed in an opposite direction from the first material engaging said first helical flight, and from said outlet end toward said stucco discharge opening;

a plurality of air knives constructed and arranged for directing compressed air to said screen for dislodging material caught on an interior surface of said screen;

said plurality of air knives includes a first plurality of knives at a first height in operational relationship to said exterior surface of said screen, and a second plurality of knives at a second height distinct from said first height in operational relationship to an outer edge of said at least one second flight; and a power unit and a power transmission system connected to said power unit for rotating in common said shaft, said at least one first flight, said screen and said at least one second flight.

* * * * *